US009707764B2

(12) United States Patent
Gengrinovich et al.

(10) Patent No.: US 9,707,764 B2
(45) Date of Patent: Jul. 18, 2017

(54) DETERMINATION OF FLUID CONSUMPTION

(71) Applicant: Hewlett-Packard Industrial Printing LTD, Fort Collins, CO (US)

(72) Inventors: Semion Gengrinovich, Ramat Gan (IL); Liad Weissman, Netanya (IL); Lev Superfin, Netanya (IL)

(73) Assignee: Hewlett-Packard Industrial Printing LTD., Netanya (IL)

( * ) Notice: Subject to any disclaimer, the term of this patent is extended or adjusted under 35 U.S.C. 154(b) by 766 days.

(21) Appl. No.: 13/628,350

(22) Filed: Sep. 27, 2012

(65) Prior Publication Data

US 2014/0085361 A1 Mar. 27, 2014

(51) Int. Cl.
*B41J 2/165* (2006.01)
*B41J 2/175* (2006.01)

(52) U.S. Cl.
CPC ..... *B41J 2/175* (2013.01); *B41J 2/16523* (2013.01); *B41J 2/16526* (2013.01); *B41J 2002/17576* (2013.01)

(58) Field of Classification Search
USPC ..... 347/7, 36, 85, 86, 89
See application file for complete search history.

(56) References Cited

U.S. PATENT DOCUMENTS

| | | | | |
|---|---|---|---|---|
| 5,963,237 | A * | 10/1999 | Ikkatai et al. | 347/85 |
| 6,663,220 | B2 * | 12/2003 | Suzuki et al. | 347/36 |
| 7,472,986 | B2 * | 1/2009 | Hori | B41J 2/155 347/40 |
| 8,336,999 | B2 * | 12/2012 | Matsumoto et al. | 347/85 |
| 8,382,222 | B2 * | 2/2013 | Shinkai | 347/7 |
| 2002/0191039 | A1 * | 12/2002 | Minowa et al. | 347/7 |
| 2006/0061620 | A1 * | 3/2006 | Tani et al. | 347/36 |
| 2007/0120913 | A1 * | 5/2007 | Mukai | B41J 2/175 347/93 |

* cited by examiner

*Primary Examiner* — Lam Nguyen
(74) *Attorney, Agent, or Firm* — HP Inc. Patent Department

(57) ABSTRACT

The method of operating an inkjet printing system includes ejecting usable fluid on a substrate in a print mode and in a purge container in a maintenance mode by a print head. The method also includes receiving recovered fluid from the purge container and source fluid from the source supply to form the usable fluid in a primary fluid tank. The method also includes receiving and providing an amount of the usable fluid from the primary fluid tank to the print head by at least one of a first supplemental fluid tank and a second supplemental fluid tank. The method also includes determining a consumed amount of the usable fluid corresponding to an amount of the usable fluid used by the print head reduced by an amount of the recovered fluid received by the primary fluid tank from the purge container.

20 Claims, 5 Drawing Sheets

DETERMINATION OF FLUID CONSUMPTION

BACKGROUND

Inkjet printing systems may include a print head having nozzles and a fluid supply system to supply fluid such as ink to the print head. The print head may include a print mode to eject fluid onto a substrate and a maintenance mode to eject fluid to maintain the print head. In the maintenance mode, the print head may be purged by the ejection of fluid through the nozzles thereof.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

An inkjet printing system may include a print head having nozzles and a fluid supply system to supply fluid such as ink to the print head. An inkjet printing systems may include a commercial, high speed print press including print heads in a form of an elongated print head array including a plurality of print head modules. The print head may include a print mode to eject fluid onto a substrate and a maintenance mode to eject fluid to maintain the print head. In the print mode, for example, the print head may eject fluid through nozzles to form an image on a substrate. In the maintenance mode, the print head may be purged by the ejection of fluid through the nozzles. Fluid consumed by the print head may include fluid used by the print head in the print mode and the maintenance mode. For example, consumed fluid may be estimated by counting a number of ink droplets ejected from the print head may be counted in the print mode and estimating an amount of fluid used in the maintenance operation. Such information may be helpful to a user in planning print jobs and/or replenishing fluid supplies. However, actual amounts of consumed fluid consumed by the print head may differ from the estimated amounts due to drop volume changes, varying purging fluid amounts, and the like. Accordingly, efficiency in print job planning and/or fluid supply replenishment may be decreased.

In examples, the method of operating an inkjet printing system may include ejecting usable fluid on a substrate in a print mode and in a purge container in a maintenance mode by a print head. The method may also include receiving recovered fluid from the purge container and source fluid from the source supply to form the usable fluid in a primary fluid tank. The method may also include receiving and providing an amount of the usable fluid from the primary fluid tank to the print head by at least one of a first supplemental fluid tank and a second supplemental fluid tank. The method may also include determining a consumed amount of the usable fluid corresponding to an amount of the usable fluid used by the print head reduced by an amount of the recovered fluid received by the primary fluid tank from the purge container. Accordingly, the determination and use of an actual amount of recovered fluid and the amount of fluid used in the print mode through supplemental fluid tanks may provide the amount of fluid consumed even in an environment with drop volume changes and vary purging fluid amounts. Such information may be helpful to a user in planning print jobs and/or replenishing fluid supplies. Accordingly, efficiency in print job planning and/or fluid supply replenishment may be provided.

Figure 1:
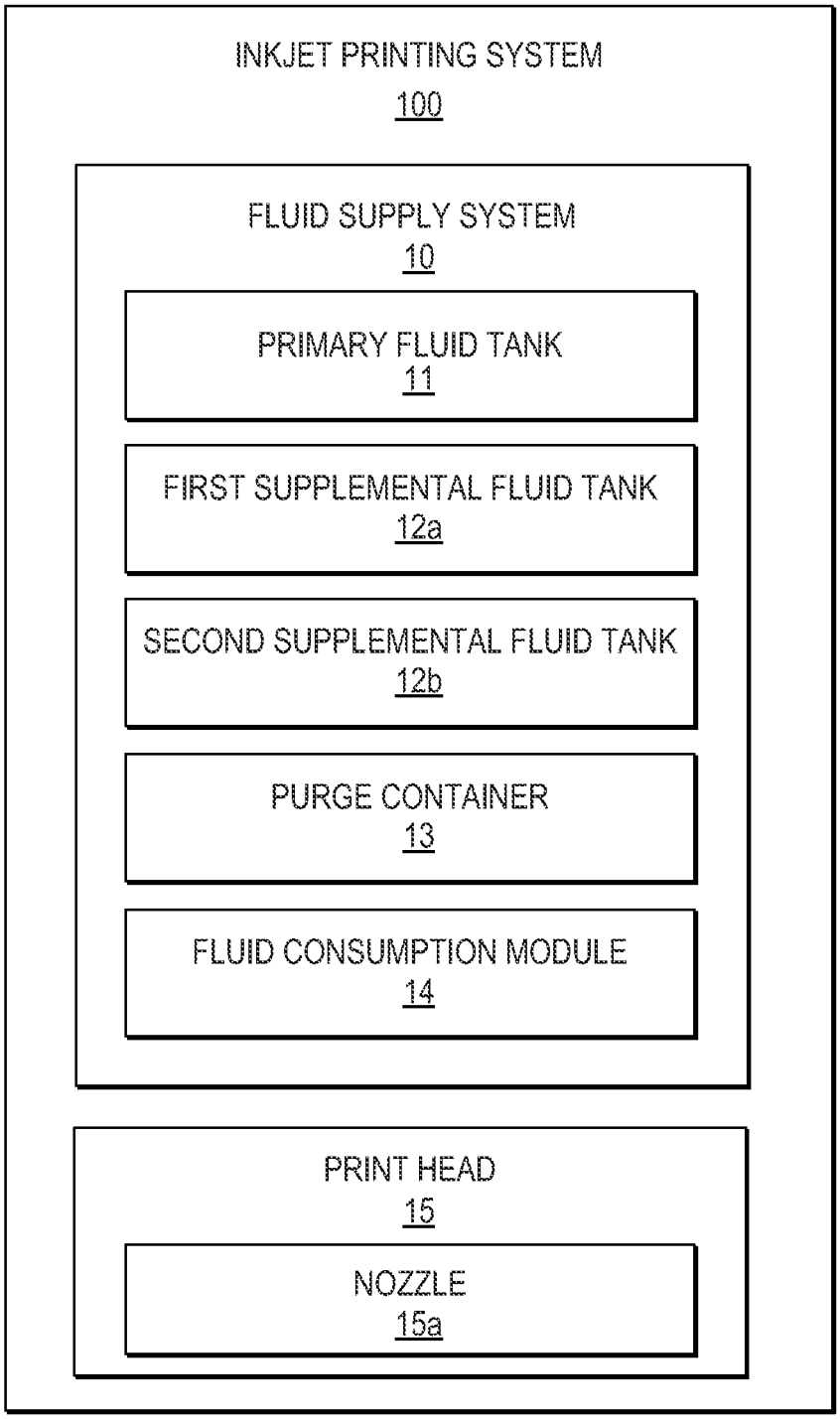
FIG. 1 is a block diagram illustrating an inkjet printing system according to an example.

FIG. 1 is a block diagram illustrating an inkjet printing system according to an example. Referring to FIG. 1, in some examples, an inkjet printing system 100 may include a print head 15 having nozzles 15*a* and a fluid supply system 10 to supply usable fluid to the print head 15. The print head 15 may eject the usable fluid on a substrate in a print mode, for example, to form an image thereon and in a purge container 13 such as a tray in a maintenance mode to purge the print head 15. The purging, for example, may maintain and/or remove obstructions form the nozzles 15*a*, and the like. Usable fluid may include fluid such as ink to be initially used and recovered fluid. That is, the fluid to be initially used by the print head 15 may be provided by a source supply having a predetermined fluid capacity that may be in a form, for example, of a central storage tank, a replaceable source supply, and/or a refillable source supply. Recovered fluid may be fluid previously used by the print head 15 in performance of a maintenance operation such as purging to be reused by the print head 15.

Referring to FIG. 1, in some examples, the fluid supply system 10 may include a primary fluid tank 11, a first supplemental fluid tank 12*a*, a second supplemental fluid tank 12*b*, a purge container 13, and a fluid consumption module 14. The primary fluid tank 11 may receive recovered fluid from the purge container 13 and source fluid from a source supply to form the usable fluid. The primary fluid tank 11 may be of a predetermined size to store the usable fluid. In some examples, the size of the primary fluid tank 11 may be [in a range of about 1 to 10 liters. In some examples, the size may be determined based on throughput of inkjet printing system.

Referring to FIG. 1, in some examples, the first supplemental fluid tank 12*a* and the second supplemental fluid tank 12*b* may receive and provide an amount of the usable fluid from the primary fluid tank 11 to the print head 15. The first and second supplemental fluid tanks 12*a* and 12*b* may be disposed in close proximity to the print head 15. Each one of the first and second supplemental fluid tanks 12*a* and 12*b* may include a predetermined size to store the usable fluid to be provided to the print head 15. In some examples, the size of each one of the first and second supplemental fluid tank 12*a* and 12*b* may be in a range of about 100 cubic centimeters (cc) to 1000 cc. For example, the volume capacity of each one of the first and second supplemental fluid tanks 12*a* and 12*b* may be three hundred cc. Generally, such a volume capacity may correspond to an estimated amount of fluid needed to form at least a full size image. In some examples, the print head 15 may include an elongated print head array having a plurality of print head modules. The first supplemental fluid tank 12*a* may supply usable fluid to one end of the print head 15 and the second supplemental fluid tank 12*b* may supply usable fluid to another end of the print head 15. The purge container 13 may receive an amount of the usable fluid ejected from the print head 15 in the maintenance mode.

Referring to FIG. 1, in some examples, the fluid consumption module 14 and/or calculation module 24 (FIG. 2) may determine a consumed amount $a_c$ of the usable fluid corresponding to an amount $a_u$ of the usable fluid used by the print head 15 reduced by an amount $a_r$ of the recovered fluid received by the primary fluid tank 11 from the purge container 13. That is, $a_c=a_u-a_r$, wherein $a_c$ corresponds to the consumed amount of the usable fluid, $a_u$ corresponds to the amount of the usable fluid used by the print head 15, and $a_r$ corresponds the amount of the recovered fluid received by the primary fluid tank 11 from the purge container 13. In some examples, the fluid consumption module 14 and/or calculation module 24 may be implemented in hardware, software including firmware, or combinations thereof. The firmware, for example, may be stored in memory and executed by a suitable instruction-execution system. If implemented in hardware, as in an alternative example, the fluid consumption module 14 and/or calculation module 24 may be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the fluid consumption module 14 and/or calculation module 24 may be implemented in a combination of software and data executed and stored under the control of a computing device.

Figure 2:
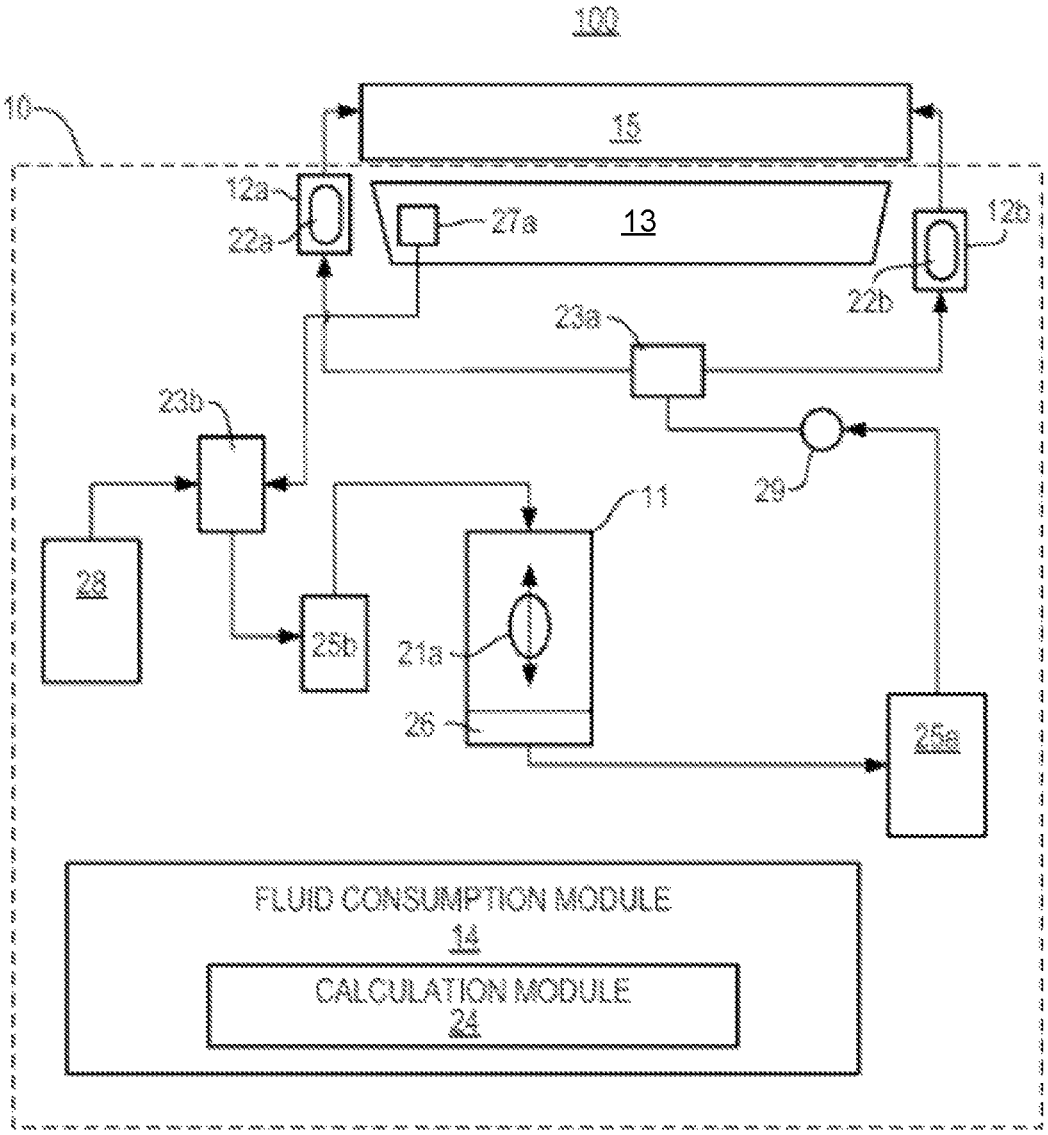
FIG. 2 is a schematic view illustrating the inkjet printing system of FIG. 1 according to an example.

FIG. 2 is a schematic view illustrating the inkjet printing system of FIG. 1 according to an example. Referring to FIG. 2, in some examples, the inkjet printing system 100 may include the print head 15 and the fluid supply system 10 to supply usable fluid to the print head 15 as previously disclosed with respect to FIG. 1. Additionally, the fluid supply system 100 may also include a source supply 28, a first pump 25*a*, a first valve 23*a*, a second pump 25*b*, a second valve 23*b*, a load cell 26, and a pressure sensor 29. The source supply 28 may include a predetermined fluid capacity and be in a form of a central storage tank, a replaceable source supply, and/or refillable source supply of source fluid such as ink to be provided to the print head 15. The first pump 25*a* may be selectively activated to pump a first predetermined amount $a_1$ of the usable fluid from the primary fluid tank 11 to at least one of the first supplemental fluid tank 12*a* and the second supplemental fluid tank 12*b*. The first valve 23*a* such as a three-way valve may direct the first predetermined amount $a_1$ of the usable fluid from the first pump 25*a* to the at least one of the first supplemental fluid tank 12*a* and the second supplemental fluid tank 12*b*.

Referring to FIG. 2, in some examples, the second pump 25*b* may be selectively activated to pump at least one of a second predetermined amount $a_2$ of the fluid purged from the print head 15 into the purge container 13 to the primary fluid tank 11 and a third predetermined amount $a_3$ of source fluid from the source supply 28 to the primary fluid tank 11. The second valve 23*b* may direct at least one of the fluid from the purge container 13 and the source fluid from the source supply 28 to the second pump 25*b*. The load cell 26 may be coupled to the primary fluid tank 11. The load cell 26 may determine a weight of the usable fluid f in the primary fluid tank 11. The pressure sensor 29 may determine pressure of the usable fluid. In some examples, the pressure sensor 29 may be in fluid communication with and disposed between the first pump 25*a* and the first valve 23*a* to measure fluid flow pressure fluctuations there between. Such pressure measurements may be indicative of operation of the first pump 25*a* and first valve 23 and may be used to confirm fluid consumption.

Referring to FIG. 2, in some examples, the primary fluid tank 11 may also include a primary float switch 21*a* to selectively turn on and off the second pump 25*b* based on a respective level of the usable fluid in the primary fluid tank 11. The first supplemental fluid tank 12*a* and the second supplemental fluid tank 12*b* may each include a supplemental float switch 22*a* and 22*b* to selectively turn on and off the first pump 25*a* based on a respective level of the usable fluid in the first supplemental fluid tank 12*a* and the second supplemental fluid tank 12*b*. For example, in response to use of the usable fluid by the print head 15 provided by the respective supplemental fluid tanks 12*a* and 12*b*, the respective supplemental float switch 22*a* and 22*b* may detect a decrease in the level of usable fluid within the respective supplemental fluid tanks 12*a* and 12*b* necessary to activate the first pump 25*a*. The purge container 13 may also include a purge float switch 27*a* to selectively turn on and off the second pump 25*b* based on a respective level of the fluid purged from the print head 15 in the purge container 13. For example, the respective level may be a maximum amount of fluid used to purge the print head 15.

Referring to FIG. 2, in some examples, the fluid consumption module 14 may also include a calculation module 24 to calculate the amount $a_u$ of the usable fluid used by the print head 15 by multiplying a number of activations of the first pump 25*a* by the first predetermined amount $a_1$ of the usable fluid. That is, $a_u=n_1\times a_1$, wherein $a_u$ corresponds to the amount of the usable fluid used by the print head 15, $n_1$ corresponds to the number of activations of the first pump 25*a*, and $a_1$ corresponds to the first predetermined amount of the usable fluid f. Additionally, the calculation module 24 may calculate the amount $a_r$ of the recovered fluid received by the primary fluid tank 11 from the purge container 13 by multiplying a number of activations $n_2$ of the second pump 25*b* to pump the second predetermined amount $a_2$ of the fluid purged from the print head 15 by the second predetermined amount $a_2$ of the fluid purged from the print head 15. That is, $a_r=n_2\times a_2$, wherein $a_r$ corresponds to the amount of the recovered fluid received by the primary fluid tank 11 from the purge container 13, $n_2$ corresponds to the number of activations of the second pump 25*b* to pump the second predetermined amount $a_2$ of the fluid purged from the print head 15, and $a_2$ corresponds to the second predetermined amount of the fluid purged from the print head 15.

In some examples, the fluid consumption module 14 may also determine a remaining amount $r_a$ of fluid in fluid supply system 10 based on an initial amount a of the source fluid reduced by the consumed amount $a_c$ of the usable fluid. That is, wherein $r_a=a_i-a_c$, wherein $r_a$ corresponds to the remaining amount of fluid in fluid supply system 10, $a_i$ corresponds to the initial amount of the source fluid, and $a_c$ corresponds to the consumed amount of the usable fluid. Alternatively, the fluid consumption module 14 may determine the amount $a_r$ of the recovered fluid received by the primary fluid tank 11 from the purge container 13 by at least one of identification of the respective level of the usable fluid in the primary fluid tank 11 over respective periods of time by the primary float switch 21*a* and the weight of the usable fluid in the primary fluid tank 11 over the respective periods of time by the load cell 26.

Figure 3:
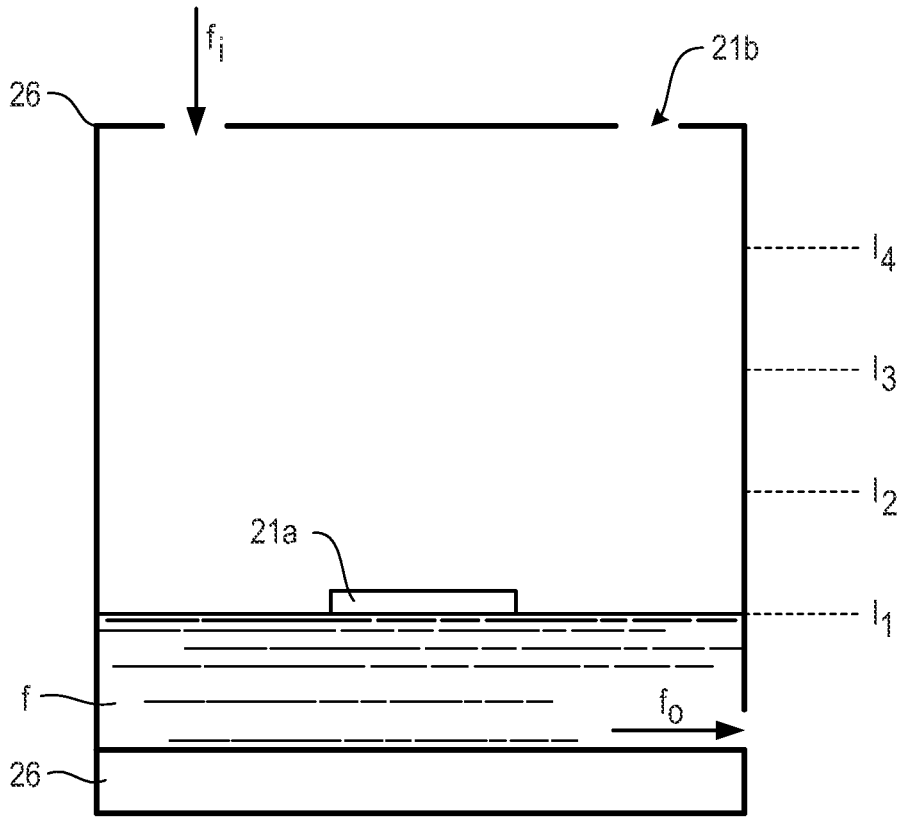
FIG. 3 is a schematic view illustrating a primary fluid tank of the inkjet printing system of FIG. 1 according to an example.

FIG. 3 is a schematic view illustrating a primary fluid tank of the inkjet printing system of FIG. 1 according to an example. Referring to FIG. 3, in some examples, the primary fluid tank 11 of the inkjet printing system 100 may include a primary float switch 21*a* as previously disclosed with respect to FIG. 2. For example, the primary float switch 21*a* may selectively turn on and off the second pump 25*b* based on a respective level of the usable fluid f in the primary fluid tank 11. In some examples, the respective levels may correspond to a first level $I_1$ such as a critical low level, a second level $I_2$ such as a low operating level, a third level $I_3$ such as a normal operating level, and a fourth level $I_4$ such as an overflow level.

In some examples, the second pump 25*b* may be initiated in response to the usable fluid in the primary fluid tank 11 reaching the first level $I_2$ and deactivated in response to usable fluid reaching the fourth level $I_4$. The second pump 25*b* may also be initiated in response to the usable fluid in the primary fluid tank 11 reaching the second level $I_2$ and deactivated in response to the usable fluid reaching the third level $I_4$ to maintain a normal operating level of usable fluid in the primary fluid tank 11. The usable fluid f from the second pump 25*b* (FIG. 2) may enter the primary fluid tank 11 though an inlet and exit from the primary fluid tank 11 through an outlet to the first pump 25*a*. A vent 21*b* in the primary fluid tank 11 may enable the primary fluid tank 11 to communicate with ambient air to maintain atmospheric pressure therein.

Figure 4:
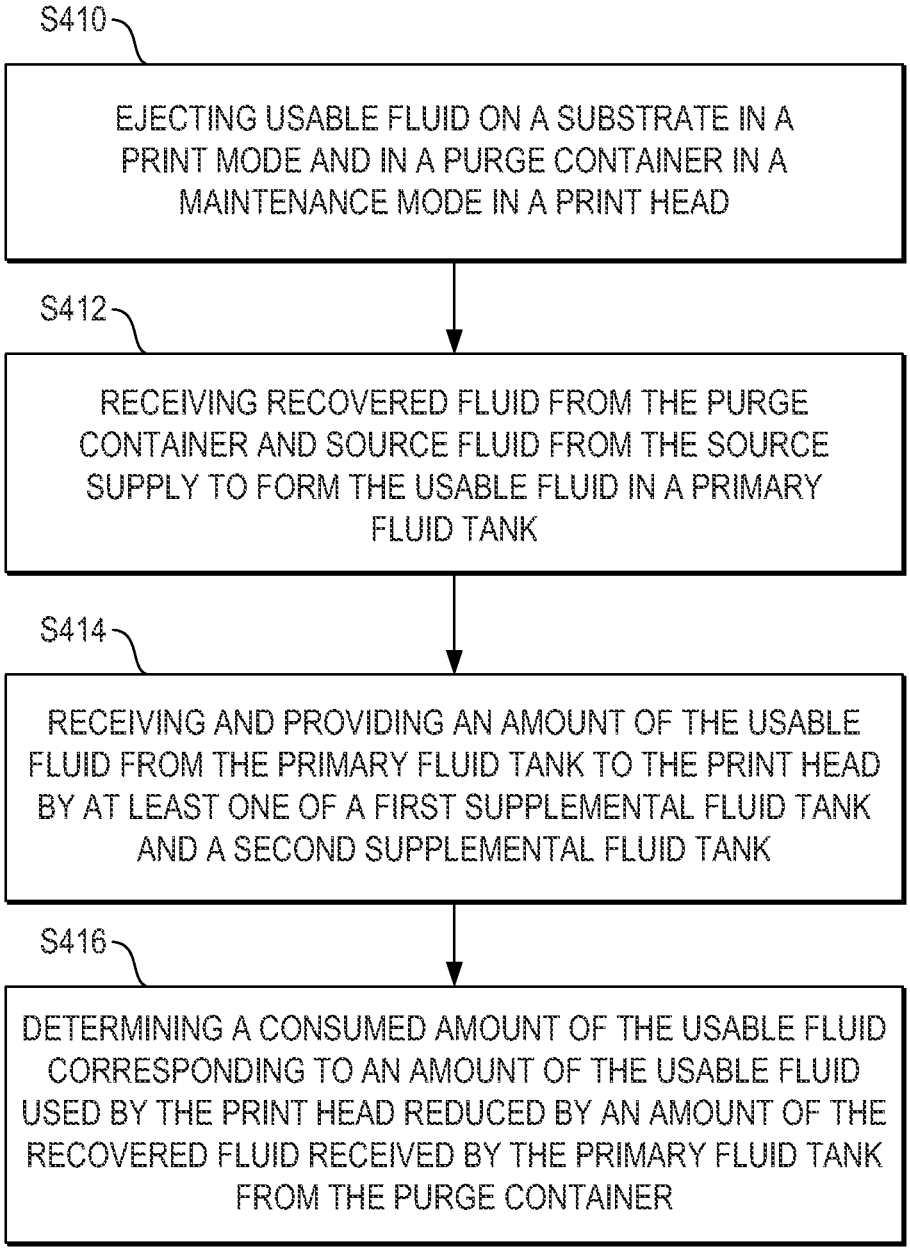
FIG. 4 is a flowchart illustrating a method of operating an inkjet printing system according to an example.

FIG. 4 is a flowchart illustrating a method of operating an inkjet printing system according to an example. Referring to FIG. 4, in block S410, usable fluid is ejected on a substrate in a print mode and in a purge container in a maintenance mode by a print head. In block S412, recovered fluid is received from the purge container and source fluid from the source supply to form the usable fluid in a primary fluid tank. For example, a second pump may be selectively activated to pump at least one of a second predetermined amount of the fluid purged from the print head into the purge container to the primary fluid tank and a third predetermined amount of the source fluid from the source supply to the primary fluid tank.

In block S414, an amount of the usable fluid is received and provided from the primary fluid tank to the print head by at least one of a first supplemental fluid tank and a second supplemental fluid tank. For example, a first pump may be selectively activated to pump a first predetermined amount of the usable fluid from the primary fluid tank to the at least one of the first supplemental fluid tank and the second supplemental fluid tank. In block S416, a consumed amount of the usable fluid is determined corresponding to an amount of the usable fluid used by the print head reduced by an amount of the recovered fluid received by the primary fluid tank from the purge container. For example, the amount of the usable fluid used by the print head may be calculated by multiplying a number of activations of the first pump by the first predetermined amount of the usable fluid. Additionally, the amount of the recovered fluid received by the primary fluid tank from the purge container may be calculated by multiplying a number of activations of the second pump to pump the second predetermined amount of the fluid purged from the print head by the second predetermined amount of the fluid purged from the print head.

In some examples, the method may also include selectively turning on and off the second pump based on a respective level of the usable fluid in the primary fluid tank by a primary float switch. Selectively turning on and off the first pump based on a respective level of the usable fluid in the at least one of the first supplemental fluid tank and the second supplemental fluid tank by supplemental float switches, respectively. Selectively turning on and off the second pump based on a respective level of the fluid purged from the print head in the purge container by a purge float switch. Additionally, a weight of the usable fluid in the primary fluid tank may be determined by a load cell coupled thereto.

Alternatively, the determining a consumed amount of the usable fluid corresponding to an amount of the usable fluid used by the print head reduced by an amount of the recovered fluid received by the primary fluid tank from the purge container may also include determining the amount of the recovered fluid received by the primary fluid tank from the purge container by at least one of identification of the respective level of the of the usable fluid in the primary fluid tank at respective times by the primary float switch and the weight of the usable fluid in the primary fluid tank over the respective times by the load cell.

Figure 5:
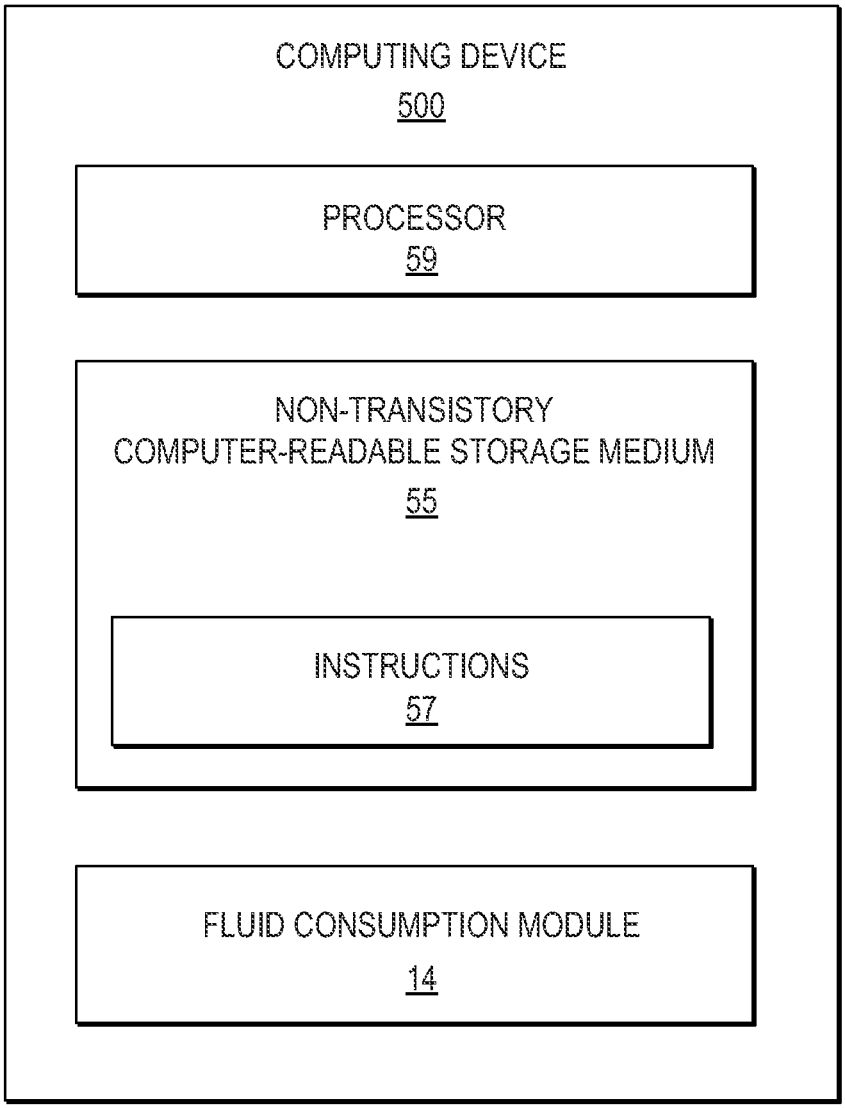
FIG. 5 is a block diagram illustrating a computing device such as an inkjet printing system including a processor and a non-transitory, computer-readable storage medium to store instructions to operate the inkjet printing system according to an example.

FIG. 5 is a block diagram illustrating a computing device such as an inkjet printing system including a processor and a non-transitory, computer-readable storage medium to store instructions to operate the inkjet printing system according to an example. Referring to FIG. 5, in some examples, the non-transitory, computer-readable storage medium 55 may be included in a computing device 500 such as an inkjet printing system. In some examples, the non-transitory, computer-readable storage medium 55 may be implemented in whole or in part as instructions 57 such as computer-implemented instructions stored in the computing device locally or remotely, for example, in a server or a host computing device considered herein to be part of the inkjet printing system.

Referring to FIG. 5, in some examples, the non-transitory, computer-readable storage medium 55 may correspond to a storage device that stores instructions 57, such as computer-implemented instructions and/or programming code, and the like. For example, the non-transitory, computer-readable storage medium 55 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 5, examples of storage devices include, but are not limited to, hard disk drives, compact disc drives, digital versatile disc drives, optical drives, and flash memory devices. In some examples, the non-transitory, computer-readable storage medium 55 may even be paper or another suitable medium upon which the instructions 57 are printed, as the instructions 57 can be electronically captured, via, for instance, optical scanning of the paper or other medium, then compiled, interpreted or otherwise processed in a single manner, if necessary, and then stored therein. A processor 59 generally retrieves and executes the instructions 57 stored in the non-transitory, computer-readable storage medium 55, for example, to operate a computing device 500 such as an inkjet printing system in accordance with an example. In an example, the non-transitory, computer-readable storage medium 55 can be accessed by the processor 59. The computer device 500 may include a fluid consumption module 14 to determine a consumed amount of determine a consumed amount of the usable fluid corresponding to an amount of the usable fluid, for example, used by a print head of an inkjet printing system.

It is to be understood that the flowchart of FIG. 4 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 4 illustrates a specific order of execution, the order of execution may differ from that which is depicted. For example, the order of execution of two or more blocks may be scrambled relative to the order illustrated. Also, two or more blocks illustrated in succession in FIG. 4 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

it is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A method of operating an inkjet printing system, the method comprising:

ejecting usable fluid on a substrate in a print mode and in a purge container in a maintenance mode by a print head;

receiving recovered fluid from the purge container and source fluid from the source supply to form the usable fluid in a primary fluid tank;

providing an amount of the usable fluid from the primary fluid tank to the print head by a first supplemental fluid tank and a second supplemental fluid tank; and determining a consumed amount of the usable fluid corresponding to an amount of the usable fluid used by the print head reduced by an amount of the recovered fluid received by the primary fluid tank from the purge container.

2. The method according to claim 1, wherein the providing an amount of the usable fluid from the primary fluid tank to the print head by a first supplemental fluid tank and a second supplemental fluid tank further comprising selectively activating a first pump to pump a first predetermined amount of the usable fluid from the primary fluid tank to the first supplemental fluid tank and the second supplemental fluid tank.

3. The method according to claim 2, wherein the receiving recovered fluid from the purge container and source fluid from the source supply to form the usable fluid in a primary fluid tank further comprising:

selectively activating a second pump to pump a second predetermined amount of the fluid purged from the print head into the purge container to the primary fluid tank and to pump a third predetermined amount of the source fluid from the source supply to the primary fluid tank.

4. The method according to claim 3, further comprising:

selectively turning on and off the second pump based on a respective level of the usable fluid in the primary fluid tank by a primary float switch;

selectively turning on and off the first pump based on a respective level of the usable fluid in the at least one of the first supplemental fluid tank and the second supplemental fluid tank by supplemental float switches, respectively;

selectively turning on and off the second pump based on a respective level of the fluid purged from the print head in the purge container by a purge float switch; and determining a weight of the usable fluid in the primary fluid tank by a load cell coupled thereto.

5. The method according to claim 3, wherein the determining a consumed amount of the usable fluid corresponding to an amount of the usable fluid used by the print head reduced by an amount of the recovered fluid received by the primary fluid tank from the purge container further comprising:

calculating the amount of the usable fluid used by the print head by multiplying a number of activations of the first pump by the first predetermined amount of the usable fluid; and calculating the amount of the recovered fluid received by the primary fluid tank from the purge container by multiplying a number of activations of the second pump to pump the second predetermined amount of the fluid purged from the print head into the purge container to the primary fluid tank by the second predetermined amount of the fluid purged from the print head.

6. The method according to claim 3, wherein the determining a consumed amount of the usable fluid corresponding to an amount of the usable fluid used by the print head reduced by an amount of the recovered fluid received by the primary fluid tank from the purge container further comprising:

determining the amount of the recovered fluid received by the primary fluid tank from the purge container by at least one of identification of the respective level of the of the usable fluid in the primary fluid tank at respective times by the primary float switch and the weight of the usable fluid in the primary fluid tank over the respective times by the load cell.

7. An inkjet printing, system, comprising:

a print head having a print mode and a maintenance mode, the print head including nozzles to eject usable fluid there through; and a fluid supply system to supply the usable fluid to the print head, the fluid supply system including:

a purge container to receive an amount of the usable fluid ejected from the print head in the maintenance mode;

a primary fluid tank to receive recovered fluid from the purge container and source fluid from a source supply to form the usable fluid;

a first supplemental fluid tank and a second supplemental fluid tank to each receive and each provide an amount of the usable fluid from the primary fluid tank to the print head; and a fluid consumption module to determine a consumed amount of the usable fluid corresponding to an amount of the usable fluid used by the print head reduced by an amount of the recovered fluid received by the primary fluid tank from the purge container.

8. The inkjet printing system according to claim 7, further comprising:

a first pump to be selectively activated to pump a first predetermined amount of the usable fluid from the primary fluid tank to the first supplemental fluid tank and the second supplemental fluid tank.

9. The inkjet printing system according to claim 8, further comprising: a first valve to direct the first predetermined amount of the usable fluid from the first pump to the at least one of the first supplemental fluid tank and the second supplemental fluid tank.

10. The inkjet printing system according to claim 7, further comprising: a second pump to be selectively activated to pump at least one of a second predetermined amount of the fluid purged from the print head into the purge container to the primary fluid tank and a third predetermined amount of the source fluid from the source supply to the primary fluid tank.

11. The inkjet printing system according to claim 10, further comprising: a second valve to direct at least one of the fluid from the purge container and the source fluid from the source supply to the second pump.

12. The inkjet printing system according to claim 11, wherein the purge container further comprises:

a purge float switch to selectively turn on and off the second pump based on a respective level of the fluid purged from the print head in the purge container.

13. The inkjet printing system according to claim 11, wherein the fluid consumption module is configured to determine a remaining amount of fluid in fluid supply system based on an initial amount of the source fluid reduced by the consumed amount of the usable fluid.

14. The inkjet printing system according to claim 8, wherein each one of first supplemental fluid tank and the second supplemental fluid tank further comprise:

a respective supplemental float switch to selectively turn on and off the first pump based on a respective level of the usable fluid in the first supplemental fluid tank and the second supplemental fluid tank.

15. The inkjet printing system according to claim 10, wherein the fluid consumption module further comprises:

a calculation module to calculate the amount of the recovered fluid received by the primary fluid tank from the purge container by multiplying a number of activations of the second pump to pump the second predetermined amount of the fluid purged from the print head by the second predetermined amount of the fluid purged from the print head.

16. The inkjet printing system according to claim 8, wherein the fluid consumption module further comprises:

a calculation module to calculate the amount of the usable fluid used by the print head by multiplying a number of activations of the first pump by the first predetermined amount of the usable fluid to determine the amount of the usable fluid used by the print head.

17. The inkjet printing system according to claim 7, wherein the primary fluid tank further comprises:

a primary float switch to selectively turn on and off a second pump based on a respective level of the usable fluid in the primary fluid tank.

18. The inkjet printing system according to claim 17, further comprising: a load cell coupled to the primary fluid tank, the load cell to determine a weight of the usable fluid in the primary fluid tank.

19. The inkjet printing system according to claim 18, wherein the fluid consumption module is configured to determine the amount of the recovered fluid received by the primary fluid tank from the purge container by at least one of identification of the respective level of the usable fluid in the primary fluid tank over respective periods of time by the primary float switch and the weight of the usable fluid in the primary fluid tank over the respective periods of time by the load cell.

20. Anon-transitory computer-readable storage medium having computer executable instructions stored thereon to operate an inkjet printing system, the instructions are executable by a processor to:

eject usable fluid on a substrate in a print mode and in a purge container in a maintenance mode by a print head;

receive recovered fluid from the purge container and source fluid from the source supply to form the usable fluid in a primary fluid tank by selectively activating a second pump to pump at least one of a second predetermined amount of the fluid purged from the print head into the purge container to the primary fluid tank and a third predetermined amount of the source fluid from the source supply to the primary fluid tank;

receive and provide an amount of the usable fluid from the primary fluid tank to the print head by a first supplemental fluid tank and a second supplemental fluid tank by selectively activating a first pump to pump a first predetermined amount of the usable fluid from the primary fluid tank to the at least one of the first supplemental fluid tank and the second supplemental fluid tank;

selectively activate a second pump based on a purge float switch located in the purge container; and determine a consumed amount of the usable fluid corresponding to an amount of the usable fluid used by the print head reduced by an amount of the recovered fluid received by the primary fluid tank from the purge container.

* * * * *